US005873377A

United States Patent [19]

Yang

[11] Patent Number: 5,873,377

[45] Date of Patent: Feb. 23, 1999

[54] HAIR CLIP IMPROVEMENT

[76] Inventor: Che-Hsi Yang, No. 167, Jih Hsin Street, Shalu Chen, Taichung Hsien, Taiwan

[21] Appl. No.: 115,613

[22] Filed: Jul. 15, 1998

[51] Int. Cl.[6] ..... A45D 8/20; A45D 8/22; A45D 8/04; A45D 8/12

[52] U.S. Cl. ..... 132/277; 132/279; 132/273; 132/278; 132/276; 132/275

[58] Field of Search ..... 132/277, 275, 132/278, 279, 280, 276, 273; 24/511, 510, 556; D28/32, 39, 40, 41, 42, 43

[56] References Cited

U.S. PATENT DOCUMENTS

| | | | |
|---|---|---|---|
| 2,171,422 | 9/1939 | Zaccaro et al. | 132/145 |
| 5,494,060 | 2/1996 | Potut | 132/277 |
| 5,642,740 | 7/1997 | Chen | 132/277 |
| 5,664,591 | 9/1997 | Potut | 132/277 |
| 5,697,388 | 12/1997 | Chang | 132/277 |

*Primary Examiner*—Gene Mancene
*Assistant Examiner*—Trang Doan
*Attorney, Agent, or Firm*—Rosenberg, Klein & Bilker

[57] ABSTRACT

A hair clip of the present invention has two securing holders deviced to secure a torsion spring therein, having securing trenches to retain two projecting parts of the spring and has two clipping elements each provided with two holded connecting protrusions and holding recesses, a pin being inserted through said connecting protrusions and said securing holders retaining said spring therein so as to enable said clipping elements hingedly open and close by means of resilience of said spring, said holding recesses providing a more secured connection of said securing holders with said clipping elements; said securing trenches retaining said projecting parts of said spring contributing to preventing rusting of the same and scratching and hurting of a user.

2 Claims, 4 Drawing Sheets

HAIR CLIP IMPROVEMENT

BACKGROUND OF THE INVENTION

A heretofore known hair clip, referring to FIG. 5, includes a pair of clipping elements 10,20, a torsion spring 40 and a pin 30 as the main parts; each of the clipping elements 10,20 has plurality of clipping teeth 11,21 provided to clip user's hair or things in between, finger press areas 12,22 at the other end of a respective clipping elements 10,20, provided for a user to exert force thereon in using the hair clip, and a pair of connecting protrusions 121,221 protruding from inner side of the respective finger press areas 12,22, and provided with pin holes 1210,2210.

The torsion spring 40 has two projecting parts 41,42 substantially projecting in opposite direction to offer resilience for the hair clip.

In combination, the pin 30 is inserted through the pin holes 1210,2210 of the connecting protrusions 121,221 and the torsion spring 40 with the projecting parts 41,42 forming a contiguous connection with the respective clipping elements 10,20.

When a user presses two finger press areas 12,22 inwardly, the clipping teeth 11,21 of the clipping elements 10,20 will hingedly seperate for things or hair to be placed in between; then, when the user release the finger press areas 12,22, the torsion spring 40 will urge the clipping elements 10,20 to approach each other to clip the hair of things firmly by means of the projecting parts 41,42 thereof.

However, the above described hair clip has the following disadvantages:

1. The torsion spring is disposed on the hair clip without covers and thus exposed to the air, so the torsion spring will influence the overall appearance of the hair clip when the torsion spring rusts after long service period.

2. It is likely that the projecting parts of the torsion spring are not closely contiguous to the clipping elements and accidentally scratch the user. Moreover, the aperture between such projecting parts and the clipping elements might unwarily clip the user's hair therebetween.

SUMMARY OF THE INVENTION

The hair clip of this invention has been deviced to provide a safer clipping service and longer service period. The hair clip has a torsion spring, a pin and two clipping elements each having two holed connecting protrusions like the prior art hair clip as described in the background, however the hair clip is further provided with two securing holders formed to connect with the clipping elements as well as retain the spring threrin. The securing holders primarily have holding rooms provided to retain the main body of the spring, plate areas substantially deviced to provide more touching area with the clipping elements, and securing trenches to retain the projecting parts of the spring therein so that while providing substantially same clipping function as the prior art hair clip, this invention further offers a protection to the spring and prevents the user from getting scratched by the sharp ends of the projecting parts.

On the other hand, the clipping elements are provided with holding recesses on the connection areas with the securing holders for a more secured combination.

BRIEF DESCRIPTION OF DRAWINGS

The invention will be better understood by referring to the accompanying drawings, wherein.

DETAILED DESCRIPTION OF THE PREFERRED EMBODIMENTS

Figure 1:
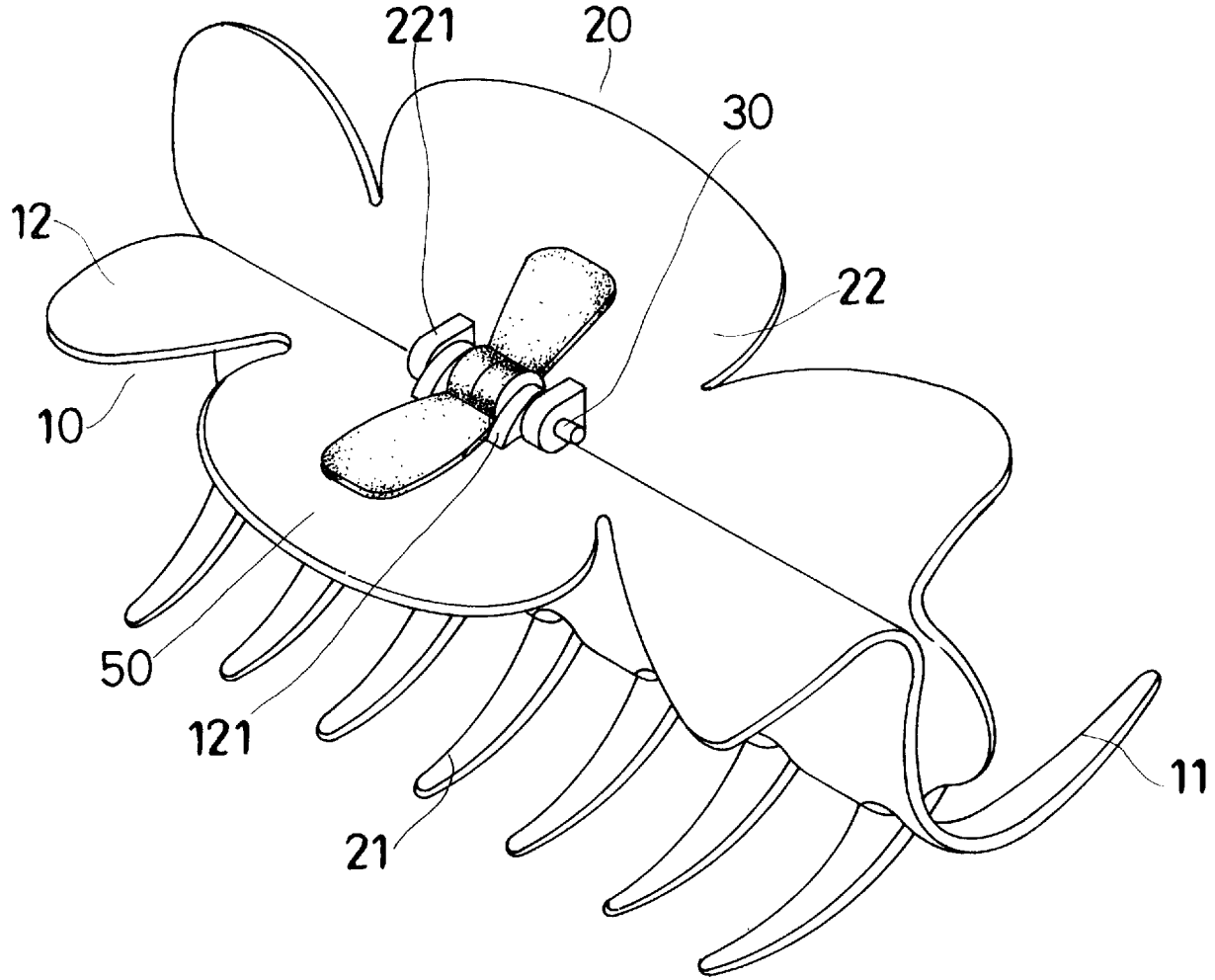
FIG. 1 is a perspective view of a hair clip of the present invention.
Figure 2:
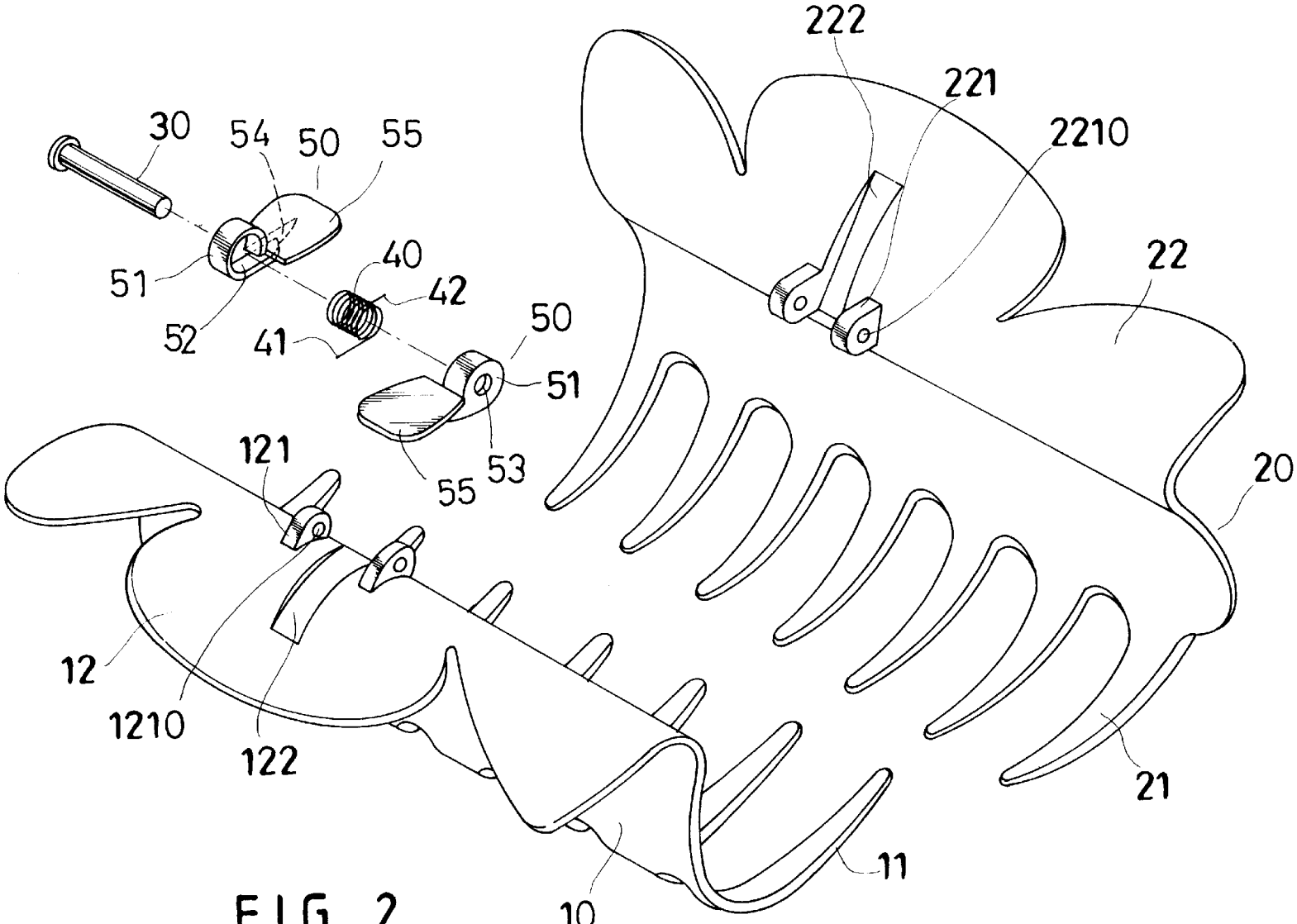
FIG. 2 is an exploded perspective of the hair clip of the present invention.
Figure 3:
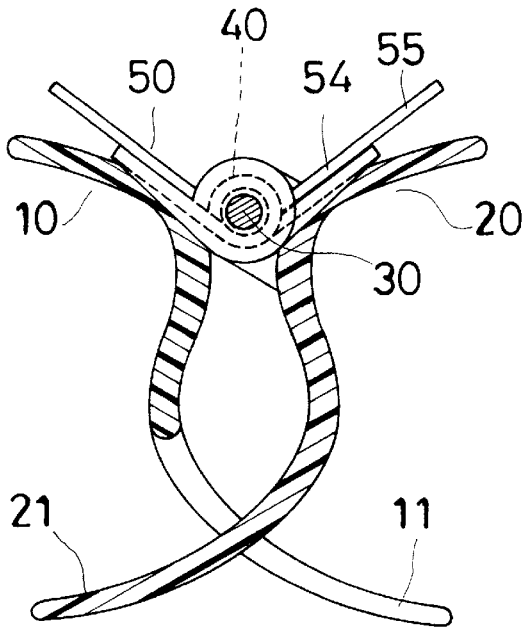
FIG. 3 is a side view showing the hair clip of the present invention in its clipping position.
Figure 4:
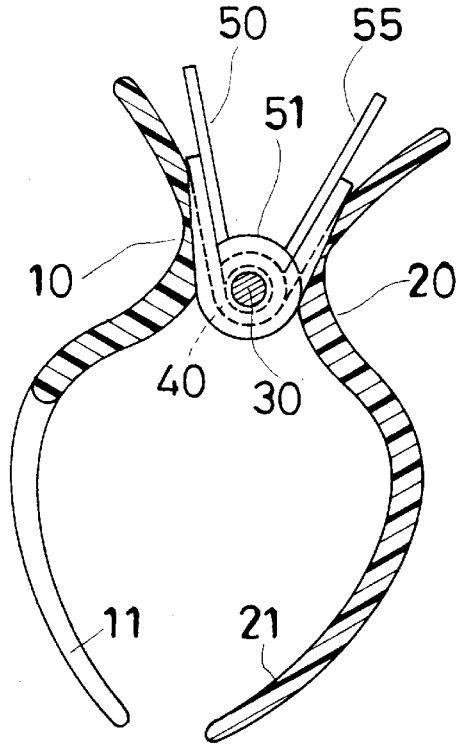
FIG. 4 is a side view showing the hair clip of the present invention in its open position; and, FIG. 5 is a view of a conventional hair clip as described in the background.
Figure 5:
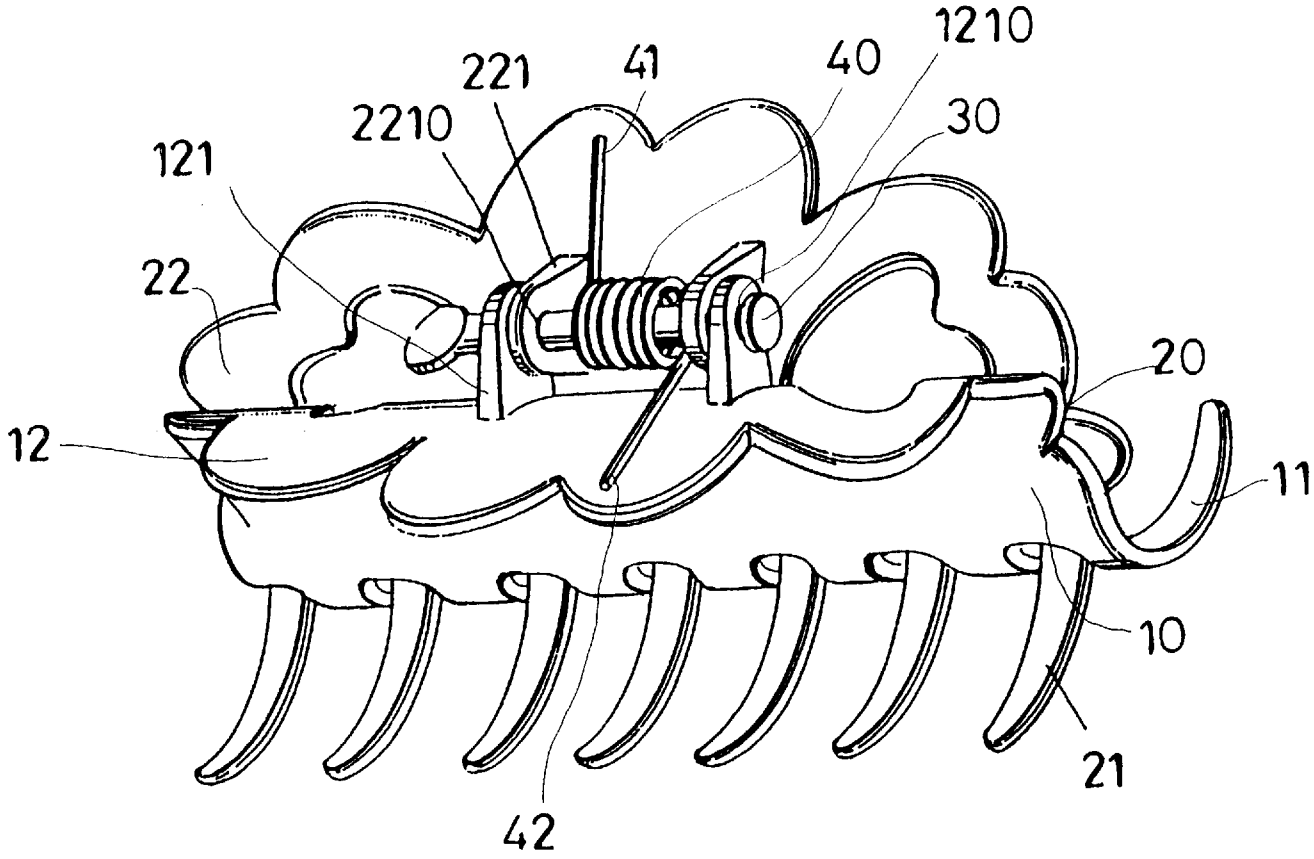
FIG. 5 (PRIOR ART)

A hair clip of the present invention, referring to FIG. 1 and 2, includes clipping elements 10,20, two securing holders 50, a torsion spring 40 and a pin 30 as the main parts; the clipping elements 10 has a plurality of longitudinally arranged clipping teeth 11 at one end, a finger press area 12 at an opposing end, two holed connecting protrusions 121 protruding from inner side of the finger press area 12, and a holding recess 122 substantially formed between the two protrusions 121;the clipping element 20 also has a plurality of clipping teeth 21, a finger press area 22, two holded connecting protrusions 221 protruding from inner side of the finger press area 22 and a holding recess 222 substantially formed between the protrusions 221.

The clipping teeth 11,21 and the finger press areas 12,22 have the same function and way of use as those of the hair clip described in the background and so is not detailed again in this section of the specification.

The torsion spring 40 has two projecting parts 41,42 substantially extending from the main body thereof in opposing direction to provide a resilience for the hair clip.

Each of the securing holders 50 has a plate area 55, a containing part 51 substantially having a "6" shape, a holding room 52 formed in the containing part 51, a through hole 53 provided in the center of the holding room and a securing trench 54 formed at open end of the "6" shaped containing part 51, communicating with the holding room 52; the plate area 55 is provided to form a contiguous relationship with a respective one of the clipping elements 10,20; main body of the torsion spring 40 can be retained in the holding rooms 52 in combination with the projecting parts 41,42 retained within a respective one of the securing trenches 54; the holding recesses 122,222 provide a room for the securing holders 50 to have a more secured connection with the clipping elements 10,20.

In combination, the pin 30 is inserted through the connecting protrusions 121,221 having the securing holders 50 and the torsion spring 40 disposed in between, with the projecting parts 41,42 of the torsion spring 40 being retained within the securing trenches 54 of the securing holders 50 and the main body of the torsion spring 40 retained within the holding rooms 52.

In using the hair clip of the present invention, when a user press the two finger press areas 12,22 inwardly, the clipping teeth 11,21 of the clipping elements 10,20 will hingedly seperate for things or the user's hair to be placed in between;then, when the user release the finger press areas 12,22, the torsion spring 40 will urging the clipping elements 10,20 to approach each other to perform the clipping function by means of the projecting parts 41,42 thereof.

From the above description of the hair clip of the present invention, it can be seen that the hair clip of the present invention has the following advantages:

1. The torsion spring is substantially covered by the securing holders so the hair clip can have a prettier appearance and the securing holders can be designed to have different shapes and forms for ornamental purpose.

2. The possibility of the torsion spring getting rusted in largely reduced due to the protection of the securing holders.

3. The risk of the projecting parts of the torsion spring scratching or hurting the user is eliminated because of the protection of the securing trenches.

What is claimed is:

1. A hair clip comprising:

(a) a first clipping element having a plurality of clipping teeth at one end, a finger press area provided opposite to said clipping teeth for a user to exert force thereon, two holed connecting protrusions, and a holding recess on an inner side of said finger press area;

(b) a second clipping element having a plurality of clipping teeth at one end, a finger press area provided opposite to said clipping teeth for a user to exert force thereon, two holed connecting protrusions, and a holding recess on an inner side of said finger press area;

(c) a torsion spring having two projecting parts opposing each other and a main body in between;

(d) two securing holders each having a plate area, a containing part, a holding room formed within said containing part and a securing trench formed at one end of said containing part, said securing trenches communicating with a respective one of said holding rooms;

(e) a pin provided to insert through said connecting protrusions of said two clipping elements with said two securing holders disposed in between, inserted by said pin and retaining said main body of said torsion spring within said holding rooms, said two projecting parts of said torsion spring being retained within a respective one of said two securing trenches, said torsion spring providing a resilience on said plate areas contiguous to said finger press areas so as to force said hair clip to a normally clipping position when said finger press areas are not pressed inwardly by a user.

2. A hair clip according to claim 1, wherein said securing holders have various designs and shapes.

* * * * *